US009642420B2

(12) United States Patent
McLachlan

(10) Patent No.: US 9,642,420 B2
(45) Date of Patent: May 9, 2017

(54) SELF-SEALING FASTENER AND GARMENT

(71) Applicant: E I DU PONT DE NEMOURS AND COMPANY, Wilmington, DE (US)

(72) Inventor: Colin A McLachlan, Sumter, SC (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 323 days.

(21) Appl. No.: 14/487,183

(22) Filed: Sep. 16, 2014

(65) Prior Publication Data

US 2015/0082517 A1 Mar. 26, 2015

Related U.S. Application Data

(60) Provisional application No. 61/881,051, filed on Sep. 23, 2013.

(51) Int. Cl.

| | |
|---|---|
| ***A41D 3/02*** | (2006.01) |
| ***A44B 19/32*** | (2006.01) |
| ***A41F 1/00*** | (2006.01) |
| ***A44B 18/00*** | (2006.01) |
| ***A41H 37/00*** | (2006.01) |
| *A44B 19/42* | (2006.01) |

(52) U.S. Cl.

CPC ..... *A44B 19/32* (2013.01); *A41F 1/00* (2013.01); *A41H 37/001* (2013.01); *A44B 18/0003* (2013.01); *A41D 2300/30* (2013.01); *A44B 19/42* (2013.01); *Y10T 24/2514* (2015.01); *Y10T 24/2717* (2015.01)

(58) Field of Classification Search

CPC ..... A41F 15/007; A41F 1/00; A41D 13/012; A41D 3/04; B63C 11/04; A44B 19/32

USPC ..... 2/336, 82, 87, 96, 2.17; 24/384

See application file for complete search history.

(56) References Cited

U.S. PATENT DOCUMENTS

| | | | | |
|---|---|---|---|---|
| 2,422,249 A * | 6/1947 | Malluk | ..... | A43B 3/02 24/389 |
| 2,507,333 A | 5/1950 | Coursey | | |
| 2,717,437 A | 9/1955 | De Mestral | | |

(Continued)

FOREIGN PATENT DOCUMENTS

| | | | | |
|---|---|---|---|---|
| AT | 192870 T | 5/2000 | | |
| DE | 19755498 A1 * | 6/1999 | ..... | A44B 19/32 |
| DE | 19935380 A1 | 2/2001 | | |

OTHER PUBLICATIONS

International Search Report, Mailed Dec. 12, 2014, for International Application No. PCT/US2014/055726, filed Sep. 15, 2014.

*Primary Examiner* — Tejash Patel

(57) ABSTRACT

This invention relates to a fastener assembly and a garment comprising same, comprising a first fastener tape and a second fastener tapes having a row of cooperating fastener elements mounted thereon attached to first and second closing tapes, the first and second closing tapes folded parallel to the row of cooperating fastener elements such that when the fastener is closed, and a meshed area of fastener elements from the first and second fastener tapes is formed, i) the external edges of each of the first and second closing tapes overlap, ii) the external edge of the first closing tape fully covers the meshed area of fastening elements, and iii) the overlap of the external edge of the first closing tape by the external edge of the second closing tape extends past the meshed area of fastening elements.

16 Claims, 6 Drawing Sheets

(56) References Cited

U.S. PATENT DOCUMENTS

| | | | | | |
|---|---|---|---|---|---|
| 3,449,764 | A * | 6/1969 | DeFazio | A41D 27/24 | 2/128 |
| 4,214,321 | A | 7/1980 | Nuwayser | | |
| 4,272,851 | A | 6/1981 | Goldstein | | |
| 4,628,545 | A | 12/1986 | Metzler | | |
| 4,772,510 | A | 9/1988 | McClure | | |
| 4,833,010 | A | 5/1989 | Langley | | |
| 4,855,178 | A | 8/1989 | Langley | | |
| 4,920,575 | A | 5/1990 | Bartasis et al. | | |
| 5,035,941 | A | 7/1991 | Blackburn | | |
| 5,162,148 | A | 11/1992 | Boye et al. | | |
| 5,529,823 | A * | 6/1996 | Aumann | A41D 3/04 | 2/108 |
| 5,626,947 | A | 5/1997 | Hauer et al. | | |
| 6,651,254 | B1 * | 11/2003 | Chang | A41D 3/04 | 2/87 |
| 6,668,384 | B1 | 12/2003 | Chang | | |
| 2006/0010660 | A1 | 1/2006 | Stenhall | | |

* cited by examiner

SELF-SEALING FASTENER AND GARMENT

BACKGROUND OF THE INVENTION

Field of the Invention

This invention relates to an improved fastener assembly suitable for use with protective apparel and a garment comprising that fastener assembly.

Description of Related Art

One function of certain personal protective apparel worn by workers is to prevent or reduce environmental contaminants from contacting the skin. Such apparel can include an encapsulating liquid-resistant and/or chemical-resistant suits or garments, or suits or garments designed to prevent dry particulates, or suits or garments designed to prevent a variety of hazards from contacting the skin. Such apparel can include such things as coveralls, shirts, coats, pants, bib coveralls, or a combination of these items. The apparel can be made with a wide variety of proprietary protective garment fabrics, barrier fabrics, laminates, and films. The apparel can also include nonwoven and/or woven fabrics and laminates of such materials with films. In some embodiments the apparel material is a multilayer-film-and-nonwoven laminate. In some embodiments the apparel material is a nonwoven that resists penetration by liquids and/or particulates.

Clearly, in preventing liquid and/or particulate intrusion into apparel, openings in the apparel are potential weak points, since the openings must be present in order for the apparel to be donned, and after donning the openings must then be adequately sealed. Any improvement in the sealing of such apparel is desired.

BRIEF SUMMARY OF THE INVENTION

This invention relates to a fastener assembly for use with a garment comprising a) a fastener having a first fastener tape and a second fastener tape, each fastener tape having an inside surface and an outside surface, each fastener tape further having a first end and a second end with the first end having a row of cooperating fastener elements mounted thereon; and b) first and second closing tapes, each closing tape having an internal edge and an external edge, wherein the second end of the first fastener tape is attached to the internal edge of the first closing tape, and the second end of the second fastener tape is attached to the internal edge of the second closing tape; and wherein the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, i) the external edges of each of the first and second closing tapes overlap, ii) the external edge of the first closing tape fully covers the meshed area of fastening elements, and iii) the overlap of the external edge of the first closing tape by the external edge of the second closing tape extends past the meshed area of fastening elements.

This invention also relates to a garment comprising protective apparel fabric and a fastener assembly for joining a first and a second area of protective apparel fabric, wherein a) the fastener assembly comprises i) a fastener having a first fastener tape and a second fastener tape, each fastener tape having an inside surface and an outside surface, each fastener tape further having a first end and a second end with the first end having a row of cooperating fastener elements mounted thereon; and ii) first and second closing tapes, each closing tape having an internal edge and an external edge, wherein the second end of the first fastener tape is attached to the internal edge of the first closing tape, and the second end of the second fastener tape is attached to the internal edge of the second closing tape; and wherein each of the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, the external edges of each of the first and second closing tapes overlap, the external edge of the first closing tape fully covers the meshed area of fastening elements, and the overlap of the external edge of the first closing tape by the external edge of the second closing tape extends past the meshed area of fastening elements; and b) the garment having first stitches attaching the fastener assembly to the first area of protective apparel fabric through the internal and external edges of the first closing tape and the first fastener tape, and second stitches attaching the fastener assembly to the second area of protective apparel fabric through the internal and external edges of the first closing tape and the second fastener tape, with the proviso the first stitches do not stitch through the second closing tape and the second stitches do not stitch through the first closing tape.

This invention also further relates to a garment comprising protective apparel fabric and a fastener assembly for joining a first and a second area of protective apparel fabric, wherein a) the fastener assembly comprises i) a fastener having a first fastener tape and a second fastener tape, each fastener tape having an inside surface and an outside surface, each fastener tape further having a first end and a second end with the first end having a row of cooperating fastener elements mounted thereon; and ii) first and second closing tapes, each closing tape having an internal edge and an external edge, wherein the second end of the first fastener tape is attached to the internal edge of the first closing tape, and the second end of the second fastener tape is attached to the internal edge of the second closing tape; and wherein each of the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, the external edges of each of the first and second closing tapes overlap, the external edge of the first closing tape fully covers the meshed area of fastening elements, and the overlap of the external edge of the first closing tape by the external edge of the second closing tape extends past the meshed area of fastening elements;

b) the garment having first stitches attaching the fastener assembly to the first area of protective apparel fabric through the internal edge of the first closing tape and the first fastener tape, and second stitches attaching the fastener assembly to the second area of protective apparel fabric through the internal edge of the second closing tape and the second fastener tape, with the proviso the first stitches do not stitch through the second closing tape and the second stitches do not stitch through the first closing tape.

DETAILED DESCRIPTION OF THE INVENTION

Fastener Assembly

Figure 1A:
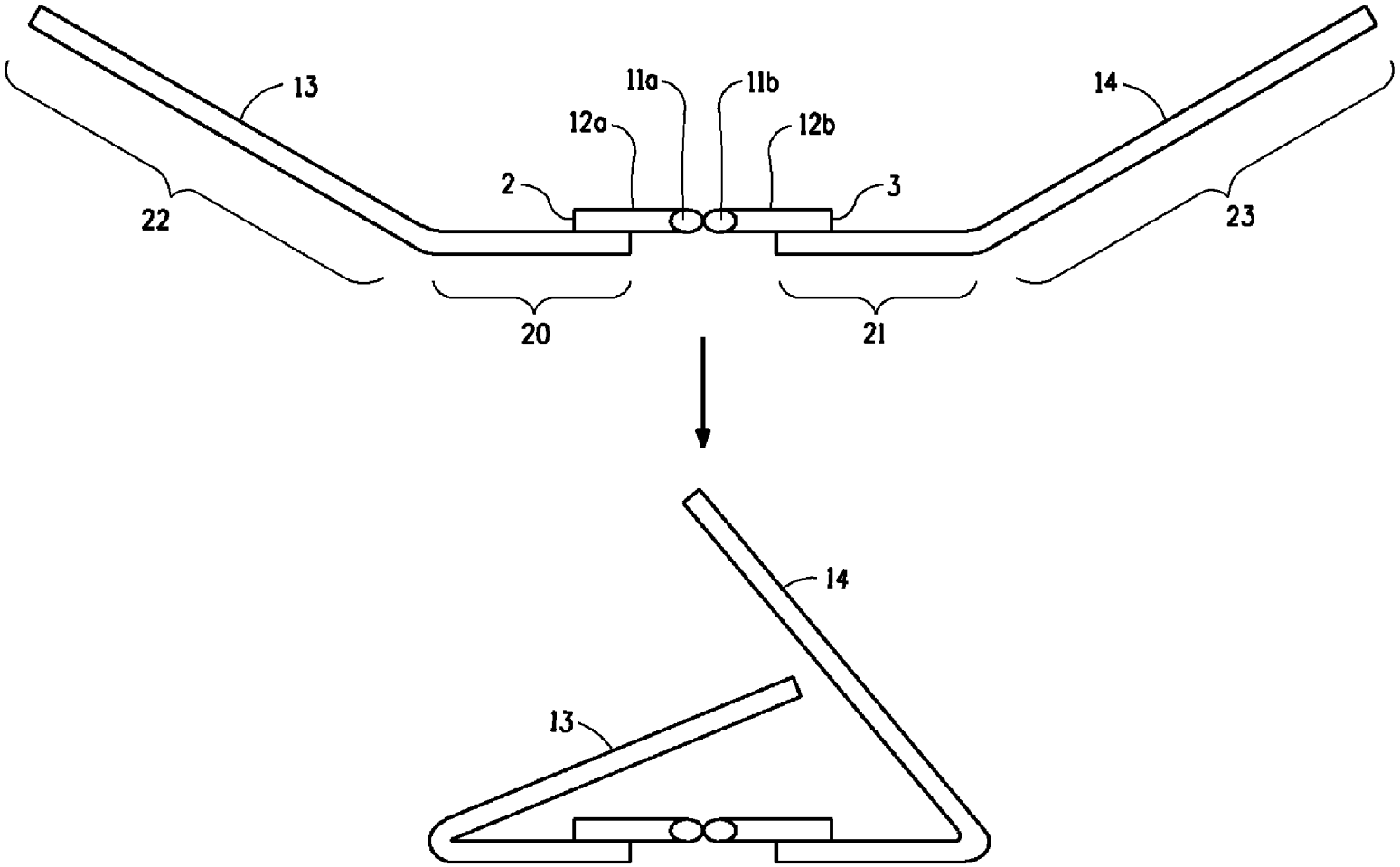
FIG. 1A is a representation of a fastener assembly for use with a garment, shown unfolded and then partially folded for clarity.

As shown in FIG. 1A, the fastener assembly for use with a garment comprises a fastener having a first fastener tape 12*a* and a second fastener tape 12*b*, each fastener tape having an inside surface and an outside surface. Further, fastener tape 12*a* has a first end having a row of cooperating fastener elements 11*a* mounted thereon and a second end 2. Fastener tape 12*b* has a first end having a row of cooperating fastener elements 11*b* mounted thereon and a second end 3. The fastener assembly further comprises a first closing tape 13 having an internal edge 20 and an external edge 22; a second closing tape 14 having an internal edge 21 and an external edge 23. The second end of the first fastener tape is attached to the internal edge 20 of the first closing tape, and the second end of the second fastener tape is attached to the internal edge 21 of the second closing tape.

Further, the length of internal edge 20 is shorter than the length of external edge 22 and the length of internal edge 21 is shorter than the length of external edge 23. In some embodiments, the fastener tape and the closing tape have barrier properties equivalent to or greater than the barrier properties of the protective apparel fabric that will be joined by the fastener assembly.

Figure 2A:
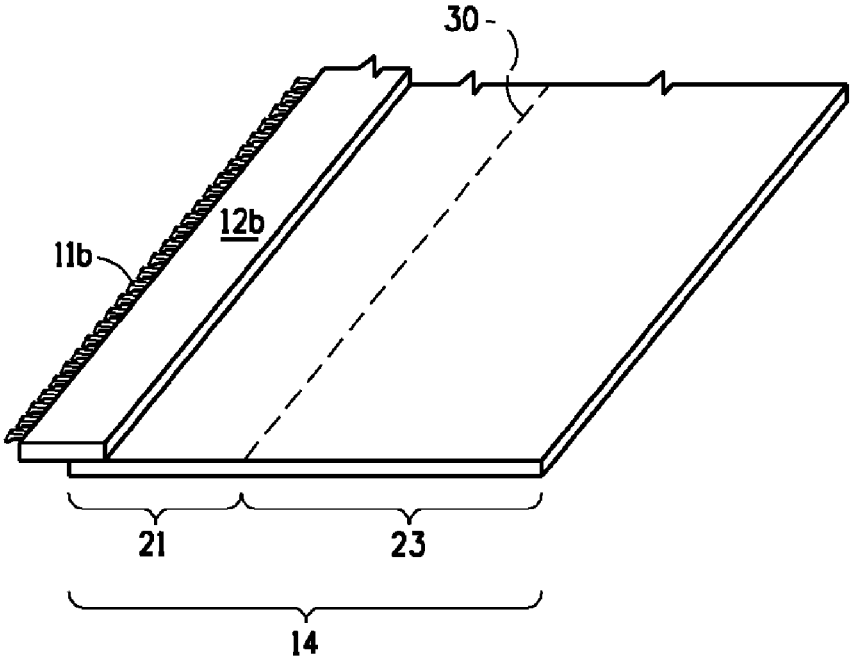
FIG. 2A is a representation of the orientation of the closing tape fold, which is parallel to the row of cooperating fastener elements; in this illustration the fastener elements are one type of slide fastener elements, particularly the teeth on a zipper.
Figure 2B:
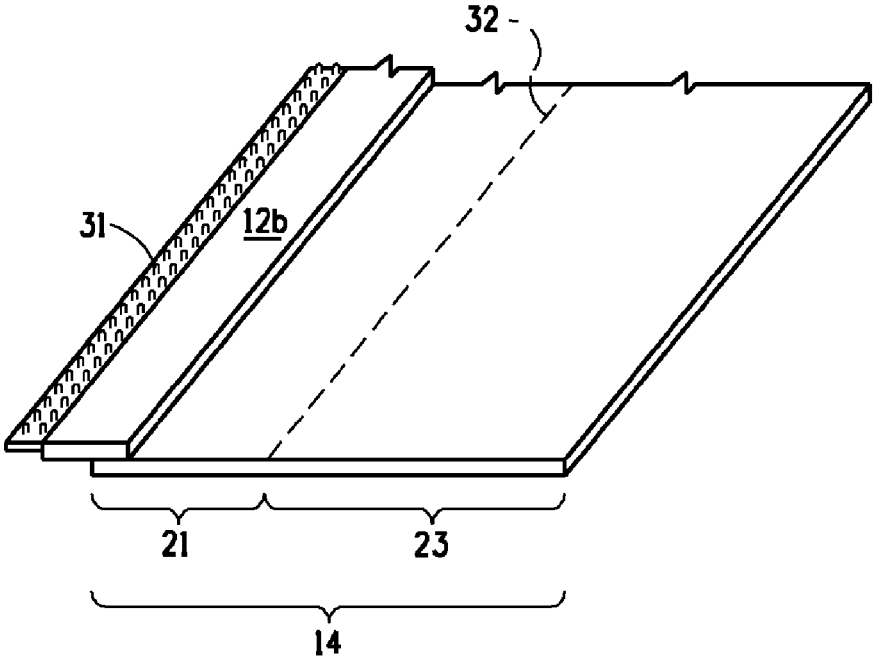
FIG. 2B is a representation of the orientation of the closing tape fold, which is parallel to the row of cooperating fastener elements; in this illustration the fastener elements are one type of velvet-type hook-and-loop fastener.

The first closing tape 13 is folded parallel to the row of cooperating fastener elements 11*a* on the first fastener tape and the second closing tape 14 is folded parallel to the row of cooperating fastener elements 11*b* on the second fastener tape. FIG. 2A is a representation of the orientation of the closing tape 14 fold, wherein the fold 30 is represented by a dotted line, the fold being parallel to the row of cooperating fastener elements 11*b*; in this illustration the row of fastener elements 11*b* is one type of slide fastener elements, particularly the teeth on a zipper. FIG. 2B is a similar representation of the orientation of the closing tape fold 32, which is parallel to the row of cooperating fastener elements 31. In this illustration the row of fastener elements 31 is a strip of one side of the type of velvet-type hook-and-loop fastener such as the one disclosed in U.S. Pat. No. 2,717,437 to de Mestral more commonly known as a Velcro® fastener. Fastener tape 13 has mirror-image corresponding folds, options, and compatible or mating fastener elements to those shown in FIGS. 2A & 2B. While these types of fastener tapes and fastener elements are useful, they are not intended to be limiting. In addition to these, it is believed a variety of fastener tapes and fastener elements can be used, including such things as magnetic sealing strips such as sold by Gooper Hermetic.

The overall length of each of the first and second closing tapes, and the relative length of the internal and external edges of the closing tapes, is selected such that when the fastener is closed the external edges of each of the first and second closing tapes overlap, and both cover the closed fastener. In particular, when the fastener is closed, the cooperating fastener elements 11*a* and 11*b* from the first and second fastener tapes mesh together, and the external edge of each closing tape is selected such that it extends over the meshed area to fully cover that area. As shown partially folded for clarity in FIG. 1A, the length of first closing tape 13 is selected such that folded external edge 22 covers the outside surface of fastener tape 12*a* and extends, or is long enough, to fully cover the meshed area. The length of second closing tape 14, which overlaps first closing tape 13, is also independently chosen such that folded external edge 23 covers a portion of the outside surface of fastener tape 12*b* and is long enough to extend past the meshed area of fastening elements, which lies beneath the first closing tape. In other words, the area of meshed fastening elements is completely covered by two layers of closing tape that are overlapped above that meshed area, each of the layers being wide enough to fully cover the meshed area independently. This helps ensure the meshed area will be fully sealed from any liquid and/or particulate material.

In some preferred embodiments, the length of first closing tape 13 is selected such that, when the fastener is closed, the external edge 22 extends past the meshed area to the area between the meshed area and the second end of second fastener tape 12*b*. In some embodiments, the length of second closing tape 14 is selected such that, when the fastener is closed, the external edge 23 extends past the meshed area to the area between the meshed area and the second end of first fastener tape 12*a*. In some preferred embodiments, the length of second closing tape 14 is selected such that, when the fastener is closed, the external edge 23 extends past the second end of first fastener tape 12*a*. In some embodiments the length of external edge 23 is longer than the length of external edge 22. Further, if desired, additional closing devices that can be easily and quickly opened and closed, such as additional strips of a velvet-type hook-and-loop fastener (like a Velcro®-type), other hook/loop devices, doubled-sided adhesive tape, interlocking spline and groove systems (such as zip lock systems), magnetic sealing strips, and the like can be used to secure the external edge 23 of closing tape 14 to the protective apparel fabric or to closing tape 13. Likewise, if desired, such additional closing devices can be used to secure the external edge 22 to internal edge 21 of closing tape 14.

While multiple types of fasteners and cooperating fastener elements are contemplated, in a preferred embodiment the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener. Some slide fasteners are commonly known as "zippers". As shown in FIG. 1C, in one embodiment, the fastener tapes 12*a* & 12*b* (or stringer tapes in the case of a slide fastener) are attached to the closing tapes 13 & 14 by use of a suitable inner sealing tape 17. Inner sealing tapes can include chlorinated polyethylene or thermo plastic synthetic rubber or other materials that are compatible with the materials being sealed. Representative commercially available inner sealing tapes are obtainable from such manufacturers as Adhesive Films, Inc., Bemis Associates, Inc., Worthen Industries, and others. In other embodiments the fastener tapes can be attached to the closing tapes by use of heat sealing, ultrasonic sealing, chemical welding, glue welding, and the like; and either the fastener tape or the closing tape may additionally be coated with a compatible material to assist in this sealing.

Garment

The garment preferably comprises a protective apparel fabric and the fastener assembly as previously described. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some preferred embodiments the protective apparel fabric, and therefore the apparel material, is a multilayer-film-and-nonwoven laminate. In some embodiments the apparel material is a nonwoven that resists penetration by liquids and/or particulates, such as a nonwoven like Tyvek® spunbonded polyethylene. Other useful protective apparel fabrics protect against a wide variety of threats and include but are not limited to those disclosed in U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boge); U.S. Pat. No. 4,833,010 (Langley).

Figure 1B:
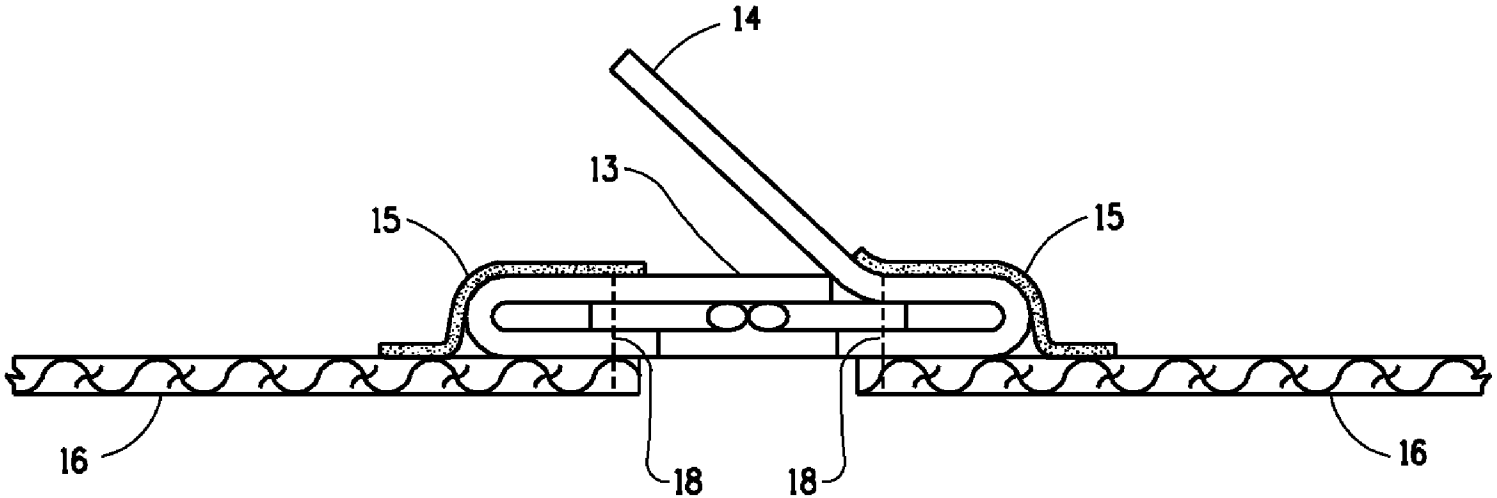
FIG. 1B is a representation of a fastener assembly in a partially folded for clarity condition and attached to first and second areas of apparel fabric and with optional outer sealing tape over the stitches and the joint with the apparel fabric.
Figure 1C:
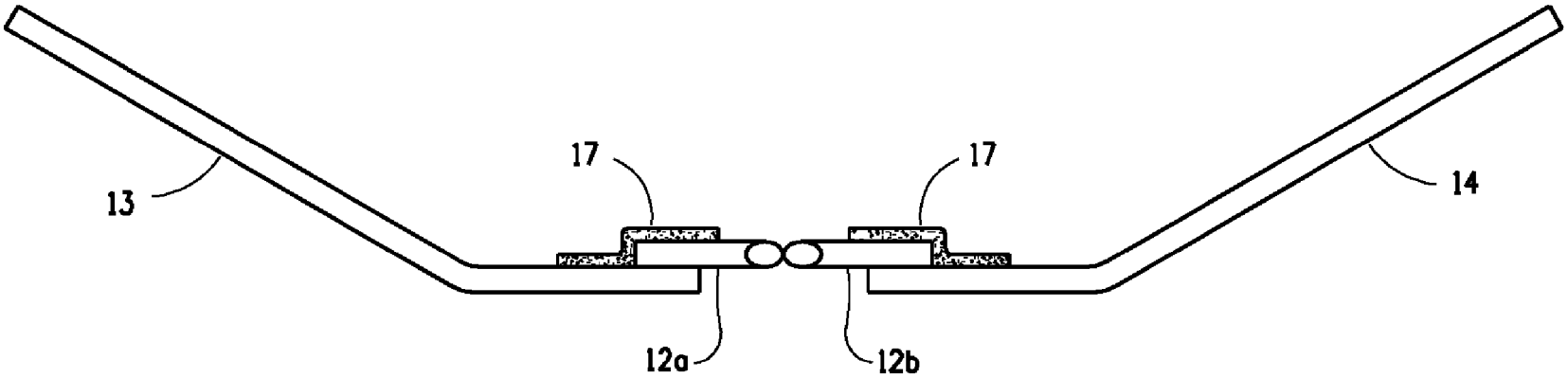
FIG. 1C is a representation of a fastener assembly for use with a garment, shown unfolded for clarity and with optional inner sealing tape attaching the fastener tapes to the closing tapes.

As shown in FIG. 1B, the fastener assembly joins first and second areas 16 of protective apparel fabric. The garment has stitches 18 attaching the fastener assembly to the first and second areas 16 of protective apparel fabric. In one embodiment, the first set of stitches 18 are sewn through the internal and external edges of the first closing tape 13, the first fastener tape 12*a*, and the first area of protective apparel fabric; and the second set of stitches are sewn through the internal and external edges of the second closing tape 14, the second fastener tape 12*b*, and the second area of protective apparel fabric. However, so that the fastener can be opened and closed, the first stitches through the first closing tape 13 do not stitch through the second closing tape 14 and the second stitches through the second closing tape 14 do not stitch through the first closing tape 13.

If the fastener assembly includes fastener tapes attached to the closing tapes by use of a suitable inner sealing tape 17 as shown in FIG. 1C, then stitches 18 preferably also pass through this sealing tape when the fastener assembly is stitched to the protective apparel fabric. In other embodiments the fastener tapes can be attached to the closing tapes by use of heat sealing, ultrasonic sealing, and the like; and either the fastener tape or the closing tape may additionally be coated with a compatible material to assist in this sealing.

Further, as shown in FIG. 1B, in some embodiments after the fastener assembly is stitched to the areas of protective fabric, the first closing tape 13 is further attached to the first area of protective apparel with outer sealing tape 15 that covers the first stitches. Likewise the second closing tape 14 is also attached to the second area of protective apparel with outer sealing tape 15 that covers the second stitches. The outer sealing tape 15 should be compatible with both the closing tape material and the protective fabric, and it also serves to cover the joint between the protective apparel fabric area and the folds in the closing tapes. Useful sealing tapes include tapes that are made from the barrier and resistant components of the protective apparel fabric. In some embodiments, the outer sealing tape 15 is made from the protective apparel fabric used in the garment. Representative commercially available outer sealing tapes are obtainable from such manufacturers as the Adhesive Films, Inc., Bemis Associates, Inc., Worthen Industries, and others; with the tape adhesives including polyurethane, polyethylene, acrylic, thermoplastic rubber, and/or hot melt systems, and others.

Figure 3:
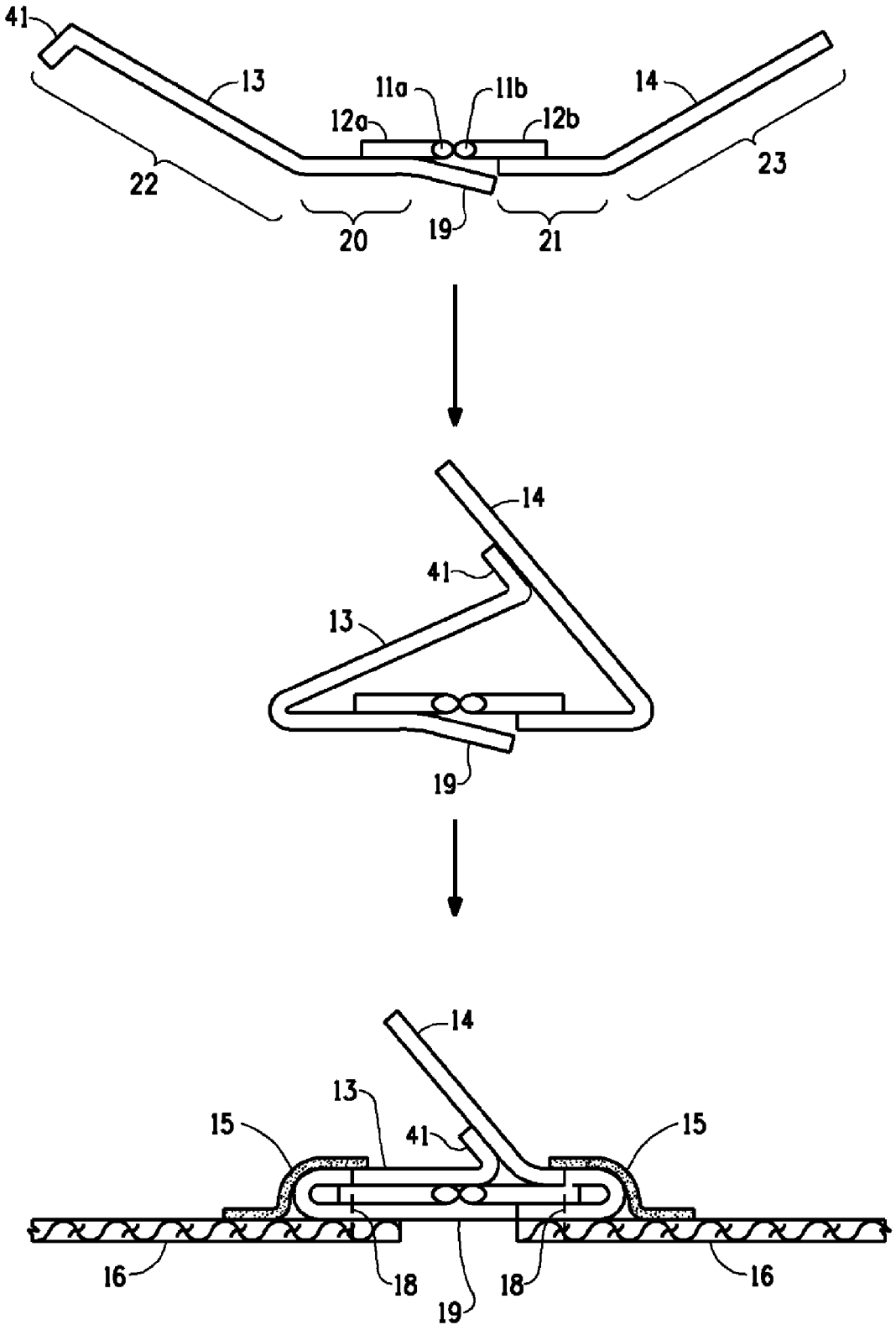
FIG. 3 is a representation of various features that can be used either separately or together with the fastener assembly in a garment; the fastener assembly is shown unfolded, partially folded for clarity, and attached to first and second areas of apparel fabric, with optional outer sealing tape.

FIG. 3 illustrates other embodiments of various features that can be used either separately or together in the fastener assembly and its attachment to the protective apparel fabric. In one feature, the external edge 22 of closing tape 13 has an additional reverse fold forming internal flap 41. Like the mirror image to fold 30 (as shown in FIG. 2A), the fold in the first closing tape 13 creating internal flap 41 is parallel to both the fold and the row of cooperating fastener elements 11*a* but in the opposite direction. As shown partially folded for clarity in FIG. 3, when the fastener is attached to first and second areas 16 of protective apparel fabric via stitches and optional outer sealing tape 15 and then closed, the reverse fold of internal flap 41 nests in the fold underneath fastener tape 14 between internal edge 21 and external edge 23 and provides a further coverage to the second closing tape stitched area. It is believed the internal flap 41 can help prevent any material or liquid that might inadvertently get underneath external edge 23 from reaching the stitched area of second closing tape 14.

In another feature, one or both of the internal edges of closing tapes 13 and/or 14 may be provided with one or more extension flaps that are positioned underneath the meshed fastener elements and cover that meshed area when the fastener is closed. As shown in FIG. 3, the internal edge 20 of closing tape 13 may have an extension flap 19 that extends beneath the inner surface of fastener tape 12*a* and beyond fastener element 11*a*. When the fastener is closed and the fastener elements 11*a* and 11*b* meshed, extension flap 19 extends beneath and beyond the meshed area and at least part of the inner surface of fastener tape 12*b*, and preferably abuts the internal edge 21 of closing tape 14. Alternatively, the extension flap can extend from the other closing tape 14 in a similar manner (not shown). It is believed this feature of covering the meshed area of the fastening elements on the inside of the closure provides an additional sealing layer against the interior of the fastener, potentially reducing the exhaust of "good air" from inside the suit that could result in "pulling" air from the environment into the suit.

Figure 4:
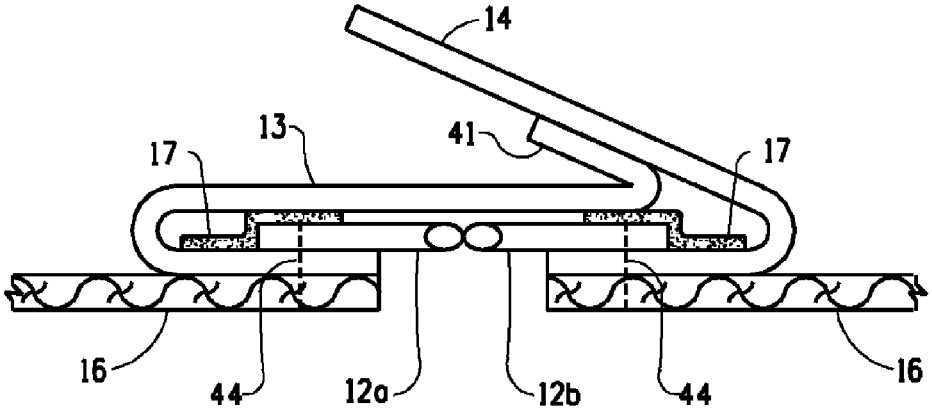
FIG. 4 is a representation of another attachment of a fastener assembly to first and second areas of apparel fabric, with optional inner sealing tape shown partially folded for clarity.

FIG. 4 illustrates another embodiment of a fastener assembly and its attachment to first and second areas of apparel fabric which finds use in garments where the threat is primarily particulate intrusion, shown partially folded for clarity. The fastener assembly joins first and second areas 16 of protective apparel fabric. The garment has stitches 44 attaching the fastener assembly to the first and second areas 6 of protective apparel fabric. In this embodiment, the first set of stitches 44 are sewn through the first fastener tape 12*a*, the internal edge 20 of closing tape 13 and the first area of protective apparel fabric 16; and the second set of stitches 44 are sewn through second fastener tape 12*b*, the internal edge 21 of second closing tape 14, and the second area of protective apparel fabric 16. However, so that the fastener can be opened and closed, the first stitches through the first closing tape 13 do not stitch through the second closing tape 14, and the second stitches through the second closing tape 14 do not stitch through the first closing tape 13. Further, in this embodiment, the stitches only pass through the internal edges of the closing tapes (20, 21); the stitches do not pass through the external edges (22, 23). FIG. 4 also shows the optional use of inner sealing tape 17 covering the stitches 44 and the joint between the fastener tape and the closing tape. Also shown is the previously-described internal flap feature 41. As before, if desired, additional closing devices that can be easily and quickly opened and closed, such as additional strips of a velvet-type hook-and-loop fastener (like a Velcro®-type), other hook/loop devices, doubled-sided adhesive tape, interlocking spline and groove systems (such as zip lock systems), magnetic strips, and the like can be used to secure the external edge 23 of second closing tape 14 to the protective apparel fabric or to closing tape 13. Likewise, such additional closing devices can be used to secure the external edge 22 of closing tape 13 to the internal edge 21 of closing tape 14.

In some embodiments, the fastener in the fastener assembly in the garment is a slide fastener, the first and second fastener tapes are stringer tapes, and the fastener elements are cooperating slide fastener elements mounted on the stringer tapes. The slide fastener further comprises a slide cooperating with the fastener elements on the stringer tapes to open and close the slide fastener. In some embodiments, the fastener in the fastener assembly in the garment is a velvet-type hook-and-loop fastener having hook and loop fastener elements. Suitable slide fasteners include, for example, urethane-coated water resistant zippers such as YKK® Aquaguard® uretek coated zippers or other water resistant zippers coated with urethane, polyethylene, or other water resistant coatings. Preferably the slide fastener has an overall length equal to the garment opening being closed. In some embodiments, the slide fastener has an overall length of from 30 to 48 inches.

While in the garment this type of fastener tapes and fastener elements is useful, is are not intended to be limiting. All of the features previously described for the fastener assembly can be used in the garment. For example, it is believed a variety of fastener tapes and fastener elements can be used, including velvet-type hook-and-loop fastener such as the one disclosed in U.S. Pat. No. 2,717,437 to de Mestral more commonly known as a Velcro® fastener such things as magnetic sealing strips such as sold by Gooper Hermetic.

In some embodiments the garment comprising protective apparel fabric and the fastener assembly is a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together.

Test Methods

Garments incorporating this closure can be tested by M. I. S. T. (Man in Simulant Test) for NFPA 1994; liquid permeation resistance according to ASTM F 1359; and resistance to protection airborne hazardous particles according to ISO 16602 Type 5 as tested by ISO 17491 methods.

Example 1

A fastener assembly is made by mounting, as shown in FIG. 1A, the two stringer tapes (12*a*, 12*b*) of a YKK® Aquaguard® uretek coated zipper having an overall length of 36 inches onto the internal edges of first and second closing tapes made from Tychem® multilayer-film-and-nonwoven laminate. The stringer tapes are mounted by sealing the stringer to the closing tape by use of a thermoplastic rubber inner sealing tape 17 as is shown in FIG. 1C. As generally illustrated in FIG. 1A, the width of the first closing tape (13) is chosen such that when folded, it has an internal edge (20) that is approximately ⅞ inches wide and an external edge (22) that is approximately 1 inch wide. The width of the second closing tape (14) is chosen such that when folded, it has an internal edge (21) that is approximately ⅞ inches wide and an external edge (23) that is approximately 1.5 inches wide.

When the fastener is closed, that is, the fastening elements are meshed, the second edge 22 of the first fastener tape 2 extends to between the meshed area and the fold in second fastener tape 3, without being caught in the stitches in fastener tape 3; and the second edge 23 of the second fastener tape 3 extends past and the meshed area. If desired, a longer second edge 23 can be chosen such that it extends past both the meshed area and the fold in fastener tape 2.

Example 2

A garment in the form of a coverall designed to limit and/or resist the ingress of liquids is made by incorporating the fastener assembly of Example 1 at the entry opening of the coveralls. The fastener assembly is attached to first and second areas of Tychem® BR multilayer-film-and-nonwoven laminate to join that fabric at the entry point in the coveralls. The fastener assembly is stitched to the first and second areas of the protective apparel fabric as shown in FIG. 1B. In particular, first stitches 18 are sewn through the internal and external edges of the first closing tape 13, the first fastener (stringer) tape 12*a*, and the first area of protective apparel fabric; and the second set of stitches are sewn through the internal and external edges of the second closing tape 14, the second fastener (stringer) tape 12*b*, and the second area of protective apparel fabric. However, so that the fastener can be opened and closed, the first stitches through the first closing tape 13 do not stitch through the second closing tape 14 and the second stitches through the second closing tape 14 do not stitch through the first closing tape 13. Outer sealing tape 15, also made from the Tychem® multilayer-film-and-nonwoven laminate, is applied to cover the stitches and the joint between the fastener assembly and the protective apparel fabric. In addition, the fastener assembly has the additional feature of an extension flap 19, as shown in FIG. 3, that extends beneath and beyond the fastener elements 11*a* and 1 lb when the fastener elements are meshed, The garment is tested via the M. I. S. T. (Man in Simulant Test) for NFPA 1994 and for liquid permeation resistance according to ASTM F 1359 and shows no ingress of liquid through the fastener assembly.

Example 3

A garment in the form of a coverall designed to limit and/or resist the ingress of particulates is made by incorporating the fastener assembly of Example 1 at the entry opening of the coverall. As in Example 2, the fastener assembly is attached to first and second areas of protective fabric to join that fabric at the entry point in the coveralls, however in this example the fabric is Tychem® QC polyethylene-coated nonwoven laminate. The fastener assembly is stitched to the first and second areas of the protective apparel fabric as shown in FIG. 4. In particular, first stitches 44 are sewn through the first fastener tape 12*a*, the internal edge 20 of closing tape 13 and the first area of protective apparel fabric 6; and the second set of stitches 44 are sewn through second fastener tape 12*b*, the internal edge 21 of second closing tape 14, and the second area of protective apparel fabric 6. However, so that the fastener can be opened and closed, the first stitches through the first closing tape 13 do not stitch through the second closing tape 14, and the second stitches through the second closing tape 14 do not stitch through the first closing tape 13. Further, in this embodiment, the stitches only pass through the internal edges of the closing tapes (20, 21); the stitches do not pass through the external edges (22, 23). Since the goal is to eliminate particulate ingress sealing tape is not needed. Also shown in FIG. 4 is inner sealing tape 17 applied to cover the stitch point and the joint between the fastener tape and the internal edges. The garment is tested for resistance to airborne hazardous particles according to ISO 16602 Type 5 as tested by ISO 17491 methods and shows no ingress of particulates through the fastener assembly.

Example 4

Examples 1 thru 3 are repeated, however, the fastener assembly is constructed with the previously-described internal flap feature 41 as shown in FIG. 3. As in Examples 2 and 3, the garments show no ingress of liquid/particulates through the fastener assembly.

The invention claimed is:

1. A fastener assembly for use with a garment comprising a) a fastener having a first fastener tape and a second fastener tape, each fastener tape having an inside surface and an outside surface, each fastener tape further having a first end and a second end with the first end having a row of cooperating fastener elements mounted thereon; and b) first and second closing tapes, each closing tape having an internal edge and an external edge, wherein the inside surface of the second end of the first fastener tape is attached to the internal edge of the first closing tape, and the inside surface of the second end of the second fastener tape is attached to the internal edge of the second closing tape; and wherein the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, i) the external edges of each of the first and second closing tapes overlap, ii) the external edge of the first closing tape fully covers the meshed area of fastening elements, and iii) the overlap of the external edge of the first closing tape by the external edge of the second closing tape extends past the meshed area of fastening elements.

2. The fastener assembly of claim 1 further comprising a reverse fold forming an internal flap on the external edge of the first closing tape, such that when the fastener is closed, the fold of the internal flap nests underneath the second closing tape between its internal edge and its external edge.

3. The fastener assembly of claim 1 wherein the internal edge of the first or second closing tapes further comprises an extension flap that covers the meshed area of fastening elements when the fastener is closed.

4. The fastener assembly of claim 1 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

5. The fastener assembly of claim 1 wherein the fastener is a hook and loop fastener having hook and loop fastener elements.

6. A garment comprising protective apparel fabric and a fastener assembly for joining a first and a second area of protective apparel fabric, wherein a) the fastener assembly comprises i) a fastener having a first fastener tape and a second fastener tape, each fastener tape having an inside surface and an outside surface, each fastener tape further having a first end and a second end with the first end having a row of cooperating fastener elements mounted thereon; and ii) first and second closing tapes, each closing tape having an internal edge and an external edge, wherein the inside surface of the second end of the first fastener tape is attached to the internal edge of the first closing tape, and the inside surface of the second end of the second fastener tape is attached to the internal edge of the second closing tape; and wherein each of the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, the external edges of each of the first and second closing tapes overlap, the external edge of the first closing tape fully covers the meshed area of fastening elements, and the overlap of the external edge of the first closing tape by the external edge of the second closing tape extends past the meshed area of fastening elements;

b) the garment having first stitches attaching the fastener assembly to the first area of protective apparel fabric through the internal and external edges of the first closing tape and the first fastener tape, and second stitches attaching the fastener assembly to the second area of protective apparel fabric through the internal and external edges of the second closing tape and the second fastener tape, with the proviso the first stitches do not stitch through the second closing tape and the second stitches do not stitch through the first closing tape.

7. The garment of claim 6 wherein the first closing tape is further attached to the first area of protective apparel with an outer sealing tape that covers the first stitches, and wherein the second closing tape is further attached to the second area of protective apparel with an outer sealing tape that covers the second stitches.

8. The garment of claim 6 wherein the fastener assembly further comprises a reverse fold forming an internal flap on the external edge of the first closing tape, such that when the fastener is closed, the fold of the internal flap nests underneath the second closing tape between its internal edge and its external edge.

9. The garment of claim 6 wherein the internal edge of the first or second closing tapes of the fastener assembly further comprises an extension flap that covers the meshed area of fastening elements when the fastener is closed.

10. The garment of claim 6 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

11. The garment of claim 6 wherein the fastener is a hook and loop fastener having hook and loop fastener elements.

12. A garment comprising protective apparel fabric and a fastener assembly for joining a first and a second area of protective apparel fabric, wherein a) the fastener assembly comprises i) a fastener having a first fastener tape and a second fastener tape, each fastener tape having an inside surface and an outside surface, each fastener tape further having a first end and a second end with the first end having a row of cooperating fastener elements mounted thereon; and ii) first and second closing tapes, each closing tape having an internal edge and an external edge, wherein the inside surface of the second end of the first fastener tape is attached to the internal edge of the first closing tape, and the inside surface of the second end of the second fastener tape is attached to the internal edge of the second closing tape; and wherein each of the first closing tape is folded parallel to the row of cooperating fastener elements on the first fastener tape, and the second closing tape is folded parallel to the row of cooperating fastener elements on the second fastener tape, such that when the fastener is closed, and a meshed area of fastener elements from the first and second fastener tapes is formed, the external edges of each of the first and second closing tapes overlap, the external edge of the first closing tape fully covers the meshed area of fastening elements, and the overlap of the external edge of the first closing tape by the external edge of the second closing tape extends past the meshed area of fastening elements;

b) the garment having first stitches attaching the fastener assembly to the first area of protective apparel fabric through the internal edge of the first closing tape and the first fastener tape, and second stitches attaching the fastener assembly to the second area of protective apparel fabric through the internal edge of the second closing tape and the second fastener tape, with the proviso the first stitches do not stitch through the second closing tape and the second stitches do not stitch through the first closing tape.

13. The garment of claim 12 wherein the fastener assembly further comprises a reverse fold forming an internal flap on the external edge of the first closing tape, such that when the fastener is closed, the fold of the internal flap nests underneath the second closing tape between its internal edge and its external edge.

14. The garment of claim 12 wherein the internal edge of the first or second closing tapes of the fastener assembly further comprises an extension flap that covers the meshed area of fastening elements when the fastener is closed.

15. The garment of claim 12 wherein the fastener is a slide fastener, the first and second fastener tapes are stringer tapes, and the fastener elements are cooperating slide fastener elements mounted on the stringer tapes, with the slide fastener further comprising a slide cooperating with the fastener elements on the stringer tapes to open and close the slide fastener.

16. The garment of claim 12 wherein the fastener is a hook and loop fastener having hook and loop fastener elements.

* * * * *